US005809591A

United States Patent [19]

Capaldi et al.

[11] Patent Number: 5,809,591

[45] Date of Patent: Sep. 22, 1998

[54] PATIENT LIFT MECHANISM

[75] Inventors: Guido Capaldi, Howell, Mich.; Mark G. Sinreich, Akron, Ohio

[73] Assignee: Lift Aid, Inc., Livonia, Mich.

[21] Appl. No.: 618,369

[22] Filed: Mar. 19, 1996

[51] Int. Cl.[6] ..... A61G 7/10

[52] U.S. Cl. ..... 5/83.1; 5/87.1; 5/89.1

[58] Field of Search ..... 5/81.1 R, 83.1, 5/84.1, 85.1, 87.1, 89.1

[56] References Cited

U.S. PATENT DOCUMENTS

| | | | |
|---|---|---|---|
| 841,702 | 1/1907 | Martin | 5/89.1 |
| 1,061,715 | 5/1913 | Allen . | |
| 1,641,388 | 9/1927 | Jenkins . | |
| 1,782,406 | 11/1930 | Bureau . | |
| 1,878,785 | 9/1932 | Leavitt . | |
| 2,634,431 | 4/1953 | Bickford . | |
| 2,688,410 | 9/1954 | Nelson | 5/83.1 X |
| 3,234,568 | 2/1966 | Fischer | 5/89.1 |
| 3,938,820 | 2/1976 | Nabinger . | |
| 4,117,561 | 10/1978 | Zamotin . | |
| 4,136,985 | 1/1979 | Taul . | |
| 4,190,233 | 2/1980 | Godfrey . | |
| 4,202,064 | 5/1980 | Joergensen . | |
| 4,243,147 | 1/1981 | Twithehell et al. | 5/89.1 X |
| 4,484,366 | 11/1984 | Koontz . | |
| 4,739,526 | 4/1988 | Hollick | 5/83.1 |
| 4,944,056 | 7/1990 | Schroeder et al. . | |
| 5,038,425 | 8/1991 | Merry . | |
| 5,158,188 | 10/1992 | Nordberg . | |
| 5,187,822 | 2/1993 | Merry . | |
| 5,327,592 | 7/1994 | Stump | 5/89.1 X |
| 5,456,655 | 10/1995 | Morris | 5/85.1 X |
| 5,511,256 | 4/1996 | Capaldi | 5/89.1 |

FOREIGN PATENT DOCUMENTS

| | | | |
|---|---|---|---|
| 304538 | 3/1989 | European Pat. Off. | 5/87.1 |
| 1461325 | 11/1966 | France . | |
| 1104138 | 4/1955 | Germany . | |
| 704508 | 2/1954 | United Kingdom . | |
| 2275604 | 9/1994 | United Kingdom . | |

*Primary Examiner*—Michael F. Trettel
*Attorney, Agent, or Firm*—Howard & Howard

[57] ABSTRACT

A patient lift system incorporates a transverse bar which carries a patient lift system for movement between two laterally extending bars. The transverse bar is mounted at the same vertical height as the laterally extending bars and carries a motor for lifting and lowering the patient. Since the transverse bar is at the same vertical height additional patient lift height is provided as compared to prior art systems. In a further feature of the present invention, the frame includes an improved corner bracket and also includes vertical adjustment for the legs to achieve leveling of the overall frame. In another feature of this invention, a patient lift bar includes four lift points, with two forward lift points spaced by a greater distance than the two rearward lift points. This provides greater support to the rear of the patient, while the additional distance in the front facilitates entry and removal of the patient lift system. In addition, an inventive sling provides a support for attachment to the lift bar which comfortably lifts the patient. In other aspects of this invention, a solid state motor control allows easy control of the speed of the motor for the patient lift system. In other features, the motor control incorporates a remote control that receives a low voltage and current such that the remote control is relatively safe to use. In a second embodiment sling, a head portion supports the patient's head, and is to the rear lift points described above. Other improvements are disclosed in the application.

20 Claims, 9 Drawing Sheets

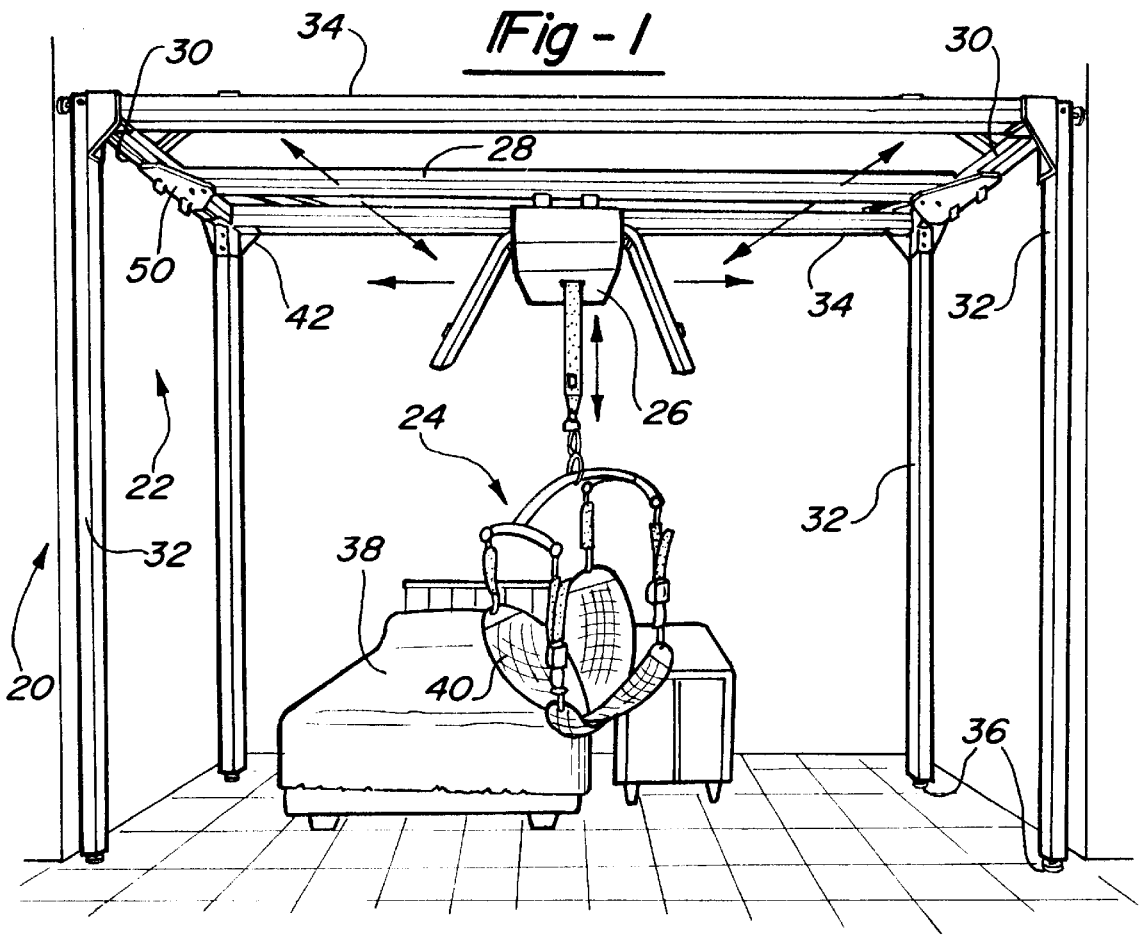
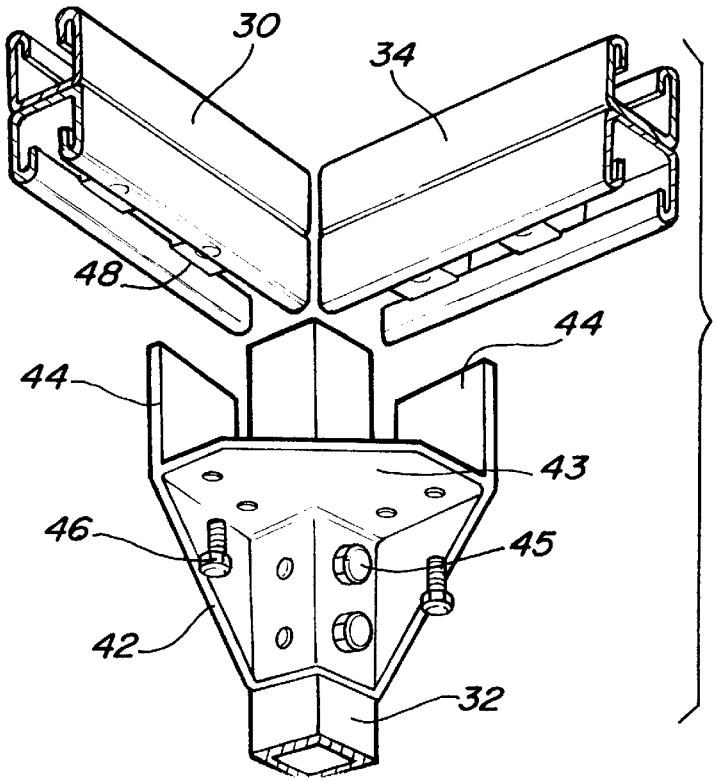
Fig - 2

Fig - 3
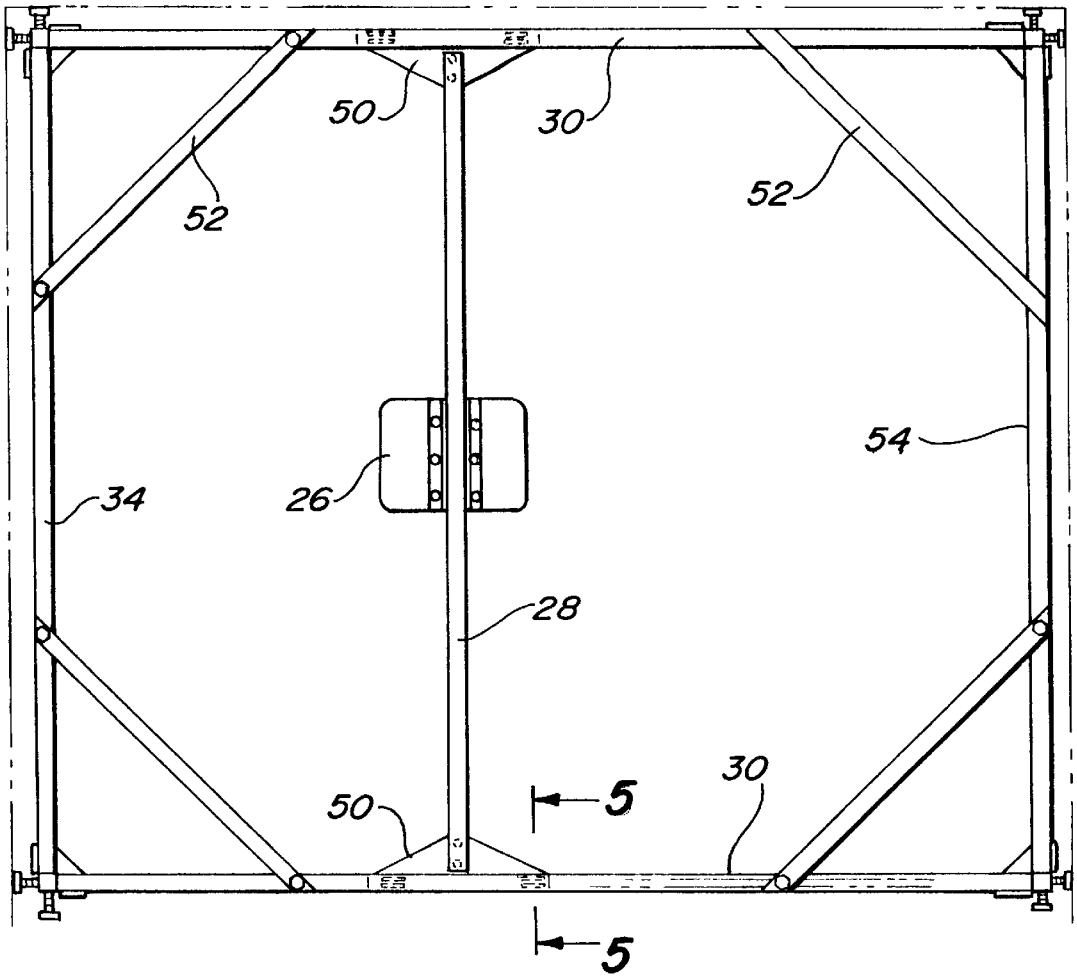
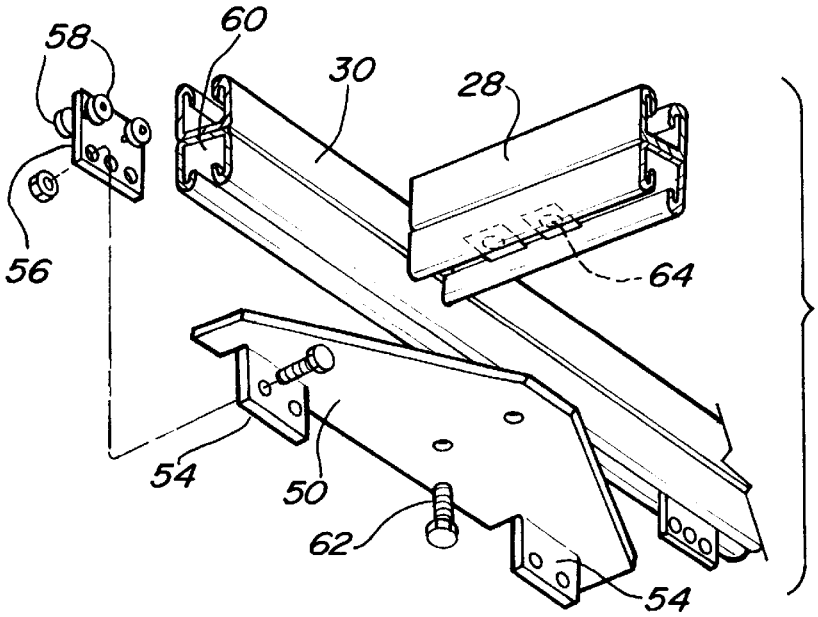
Fig - 4

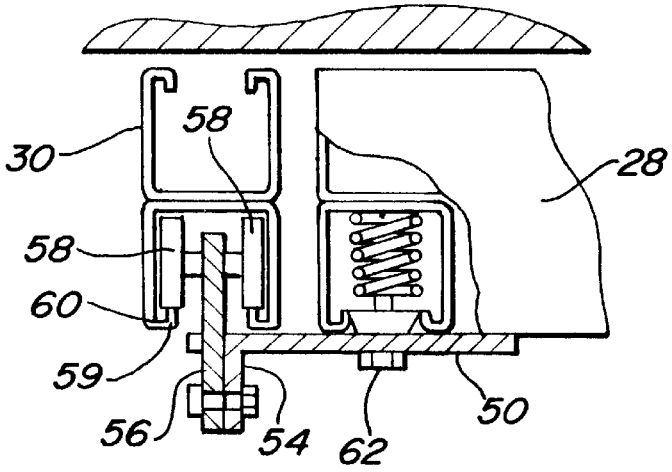
Fig - 5
Fig - 6
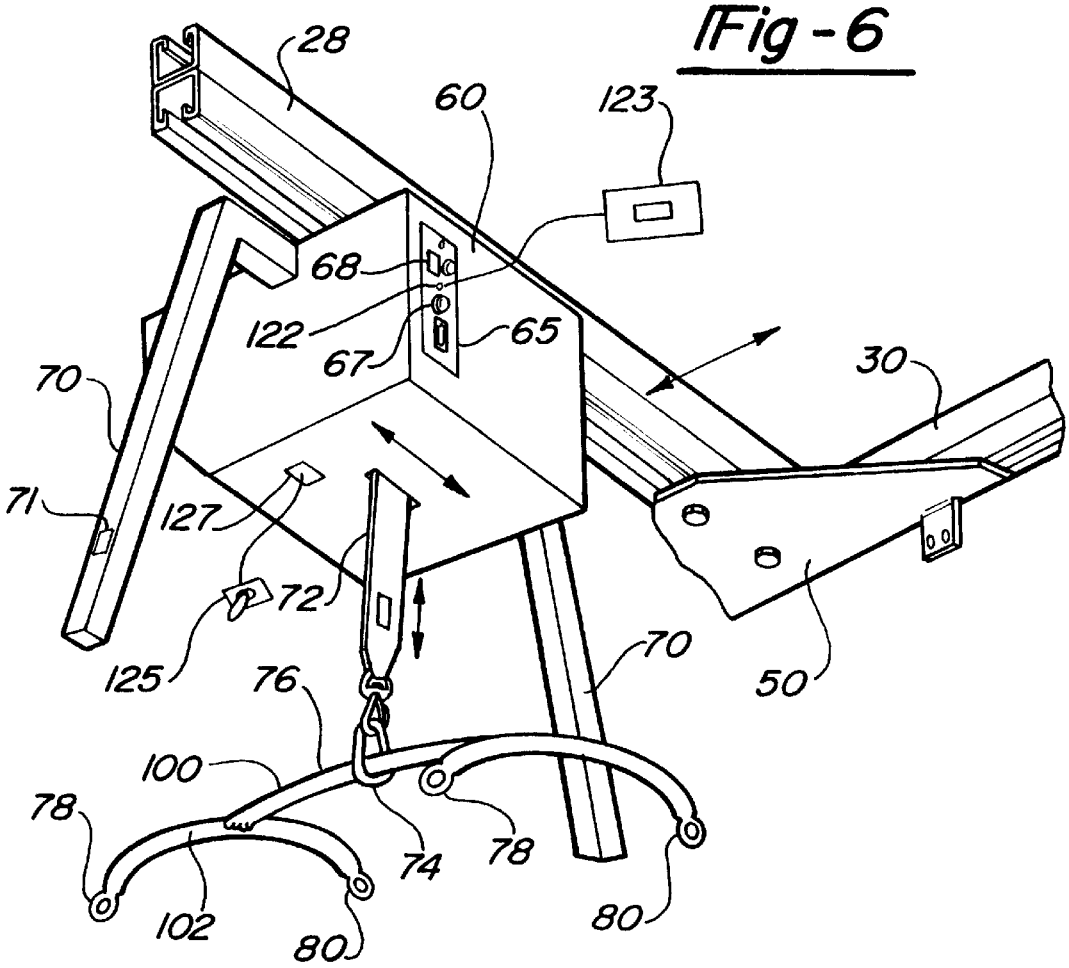

PATIENT LIFT MECHANISM

BACKGROUND OF THE INVENTION

This application is a continuation-in-part of Ser. No. 08/270,996, and, in general, relates to a lift system for lifting invalid patients from their beds.

Systems have been proposed in the prior art for use in lifting invalid patients from a bed for movement about a room. As an example, there is a need to lift invalid patients from their beds for cleaning the patient, transferring the patient to a wheelchair, gurney, etc., or for the use of a toilet. The bulk of such systems have not provided two-directional movement of the patient once the patient has been lifted. While the prior art has proposed movable systems for accomplishing these goals, there has yet to be provided a practically useful patient lift system which is capable of safely and comfortably lifting patients of various sizes and weights. In addition, the prior art systems have not been practically or reliably useful over periods of time.

The prior art movable patient lift systems have incorporated frames which have restricted the available lift height for a patient in a room with a relatively low ceiling or high bed. The frame structure has typically mounted the patient lift assembly vertically lower than the remainder of the frame. When a relatively low ceiling or high bed are encountered, since the patient lift system is mounted below the frame, the available patient lift height is restricted. Such a restriction has imposed practical limitations on the use of the prior art patient lift systems.

The prior art systems have not provided motor control features. In addition, the prior art systems have not been directed to allowing easy recharging of the batteries for the patient lift systems. Patient lift systems are not used constantly, but must be in working order when needed. When it becomes necessary to lift the patient, it is not practical to await a period of time for recharging the batteries. As such, there is a need to improve both the control and operation of the battery recharging features of the patient lift systems in the prior art. In addition, while there have been remote controls utilized in the prior art, the current and voltage to those remote controls has often been undesirably high.

The actual lift structures disclosed in the prior art have not been comfortable for the invalid patient, and further have not facilitated movement of the patient onto or off of the lift structures. The prior art has typically used solid seats, which are uncomfortable. In addition, when prior art structures have utilized washable lift members, those lift members have not been easily cleaned. As an example, the members that actually contact and lift the patient will often become soiled, and it is thus desirable to facilitate their cleaning. In the prior art, heavy metal hooks or clips have been associated with the lift members. Such heavy metal items are not easily utilized in standard washing machines, as the heavy metal could damage or destroy the machines.

The present invention seeks to address all of the above-discussed deficiencies, and others, in the prior art.

SUMMARY OF THE INVENTION

In a first embodiment of this invention, a patient lift system incorporates a lift motor driving a belt for lifting a patient upwardly off a bed. The motor is mounted for movement along a transverse bar. The transverse bar is mounted for movement in a direction perpendicular to the movement of the motor along the transverse bar, and between two laterally extending bars. By moving the motor along the transverse bar and moving the transverse bar along the laterally extending bars, one may move the patient as desired within the confines of a frame of the system. A frame is defined by the two laterally extending bars which are fixed to two longitudinally extending end bars. Legs extend upwardly to support the laterally and longitudinally extending bars at a position upwardly removed from the patient's bed. The lift height available in this system is essentially the distance between the motor and the patient's bed. In a preferred embodiment of this invention, the moving transverse bar which supports the motor is mounted laterally between the laterally extending bars. In the prior art, the bar carrying the motor is mounted lower than the laterally extending bars, thus sacrificing some patient lift height capability. In a room with limited ceiling space, the inventive structure provides valuable additional lift height. The additional available lift height makes the inventive patient lift system practically utilizable in many low-ceilinged rooms, such as are particularly found in home health care and in mobile or prefabricated homes.

In a further inventive aspect of the frame structure of this invention, the leg height is adjustable by turning adjustment bolts mounted within the bottom of the leg. Further, the transverse bar is fixed to brackets which carry wheels received in channels formed in the laterally extending bars. In a preferred embodiment of this invention, those wheels are mounted on plates which are fixed to flanges on the bracket. In a more preferred embodiment of this invention, the plates mount wheels on each longitudinal side of the plate, with the wheels riding on in-turned lips in the channels of the laterally extending bars. In a most preferred embodiment of this invention, there are two pairs of such wheels mounted on each plate and laterally spaced within the channels in the laterally extending bars.

In another feature of this invention, the laterally extended bars, the longitudinally extending bars, and the legs are connected at each corner with a corner bracket. The inventive corner brackets have back support plates which support an outer face of one of the longitudinally and laterally extending bars. A lower support plates supports a lower face of each of those bars. The corner brackets are bolted to one of the legs and are also bolted to the laterally and longitudinally extending bars. The inventive corner brackets provide rigid support at a critical junction which must support the weight of the patient as the patient is being lifted and must also keep the assembly square and resist binding of the moving elements.

In another aspect of this invention, the assembly for lifting the patient includes a rigid lift bar providing four lift points to eliminate pinching or squashing the patient. In a preferred embodiment of this invention, there are two forward lift points which are spaced by a greater distance than two rearwardly spaced lift points. A sling is attached to each of the four points. Due to the lesser spacing on the rearwardly lift points, the sling provides better support at the patient's buttocks and back area, where greater support is needed. The greater distance at the front allows the patient more comfortable access onto and off the sling and, further, greater comfort while being carried in the sling. At the same time, the greater distance at the front allows more clearance within the sling such that the patient can more easily cleaned, changed or use a toilet while in the sling.

In another feature of the sling aspect of this invention, the sling is formed of a washable mesh material having forward legs which are crossed beneath the patient to an opposed front lift point on the lift bar. The crossing of the forward legs creates an opening in the sling, which facilitates use of a toilet by the patient without falling out. In other aspects of this invention, the bar is connected to the sling through a harness by hooks moving through rings on the sling. As discussed above, in prior art slings, heavy metal hooks were mounted on the sling. This has made laundering of the slings more difficult. In the present invention, since the hooks are on a removable harness, and the sling only has relatively small rings, the sling may be easily washed in a hospital or home laundry. In a further detail, the invention uses a mesh bag to receive the sling such that the entire sling can be easily cleaned in the laundry. Further, the harness is adjustable, facilitating tailoring of the sling to the patient.

In motor control features of this invention, a solid state control is used, which facilitates several control options. A rheostat allows control of the speed of lifting the patient lift system. For certain types of patients, it may be desirable to slow the lift speed. Also, the switch to actuate the motor is an instant on/instant off switch of the type wherein the switch is normally in an off position and must be held at the "raise" or "lower" positions to actuate the motor. Further, motor control features in this invention include the use of several low battery warning lights that actuate to provide an indication that the battery strength is lowering. Other motor control features will be disclosed in more detail below.

In a further motor control feature, a circuit board receives a plug on connection leading to the sensors described above. In addition, the remote control is connected to the circuit board with a wire that receives only a small control voltage. A much higher voltage and current is utilized to power the motor, but a smaller current and voltage is sent to the remote control. In that way, the remote control is safer to utilize than prior art systems.

In a further control feature, the motor control is provided with actual speed sensors that sense the actual speed of the motor. This actual speed is compared to a desired speed, and the control adjusts the power to the motor to approach that desired speed if there is a difference between actual and desired speed. This is particularly valuable in the inventive patient lift systems, since some particularly heavy patients may increase the gravity load on the lift motor thereby reaching a higher speed than would be desired. In such cases, it is sometimes necessary to actually begin reversing the motor to slow the speed down to a desired level.

In other new features of this invention, the sling has a head portion extending from the rear sling. Hooks on the head portion are also attached to the four point support bar. Thus, the inventive sling also supports the patient's head, and other locations.

In a further aspect of this invention, the inventive system may be utilized to assist a patient in learning how to walk. The patient would be supported in such a way that the weight is removed from the patient's legs, and yet the patient is still free to walk. The sling supporting the bulk of the patient's legs allows the patient to slowly learn to walk again, utilizing this system.

The above described features and benefits of this invention will be better understood through the following specification and drawings.

BRIEF DESCRIPTION OF THE DRAWINGS

FIG. 1 is a view of a patient's room incorporating the inventive patient lift system.

FIG. 2 is a perspective view of a corner of the frame of the patient lift system according to the present invention.

FIG. 3 is a top view of the patient lift system according to the present invention.

FIG. 4 is an enlarged view of one portion of the frame of the patient lift system shown in FIGS. 1 and 3.

FIG. 5 is a cross-sectional view along 5—5 as shown in FIG. 3.

FIG. 6 is a perspective view of a portion of the patient lift system according to the present invention.

DETAILED DESCRIPTION OF THE PREFERRED EMBODIMENT

Figure 7:
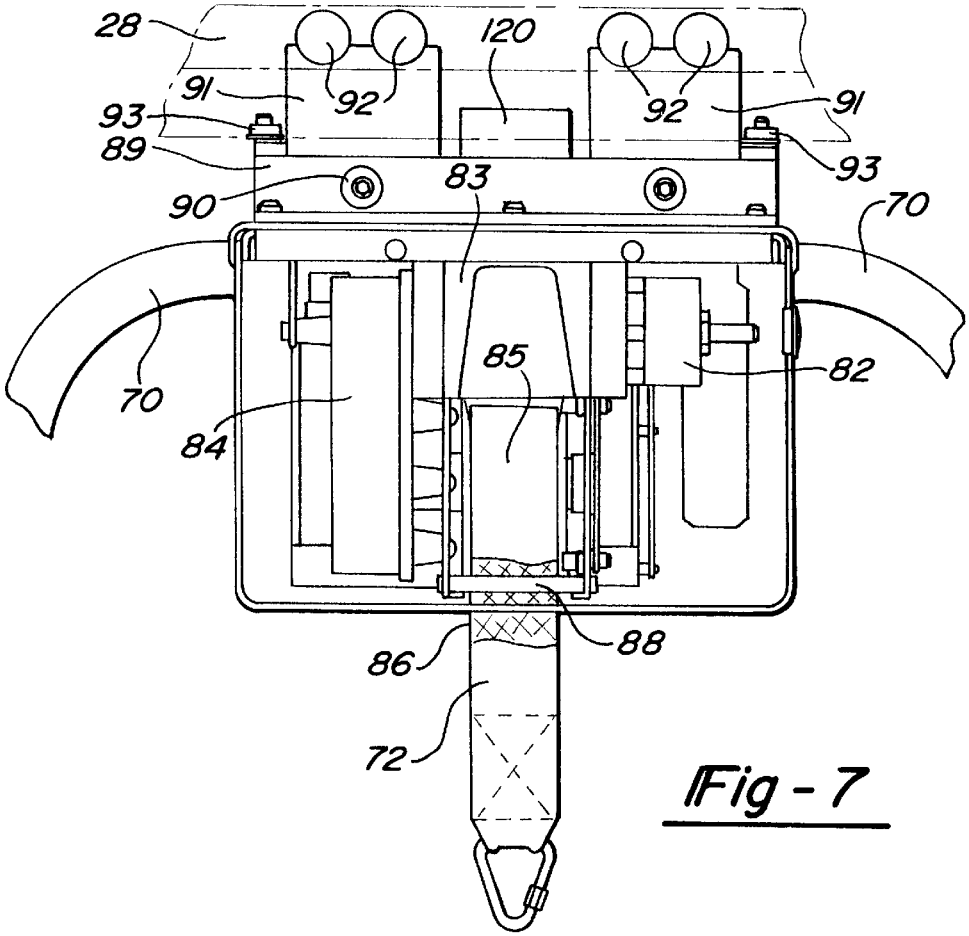
FIG. 7 is a cross-sectional view through a motor housing of the patient lift system of the present invention.

A patient lift system 20 is illustrated in FIG. 1, incorporating a rigid frame 22 mounted adjacent to the ceiling of the patient's room. Frame 22 supports a lift structure 24, including a motor 26. Motor 26 is mounted on a transverse bar 28, which is movable between laterally extending bars 30. Legs 32 support laterally extending bars 30 adjacent to the ceiling of the patient's room. Longitudinal extending bars 34 are mounted at ends of the laterally extending bars 30 and are also supported by legs 32. Transverse bar 28 can move along and between laterally extending bars 30 toward and away from the longitudinally extending bars 34. As the transverse bar 38 moves through that distance, it carries motor 26 and patient lift structure 24 (and hence, a patient in lift assembly 24) through that distance. At the same time, motor housing 26 may slide along transverse bar 28 toward and away from the two laterally extending bars 30. In this way, a patient in lift assembly 24 can be moved to any location within the boundaries of the frame 22. Legs 32 include bolt turnbuckles 36 which allow adjustment of the height of the leg 32 such that the overall frame assembly 22 may be leveled as necessary.

When a patient to be lifted is in bed 38, the sling 40 is positioned adjacent to that patient. The patient, is then positioned in the sling 40, as will be described below. The motor 26 can then lift the patient. The patient can then be moved along with the motor by sliding the motor assembly to the left and right as shown in FIG. 1 and along transverse bar 28. At the same time, the patient and the entire transverse bar 28 can move generally into and out of the plane of FIG. 1 and between the laterally extending bars 30 when it is desired to move the patient in that direction. The motor in motor housing 26 does not drive the system along transverse bar 28 or drive transverse bar 28 along laterally extending bars 30. Rather, the motor only lifts and lowers the patient in the sling 40.

Figure 13A:
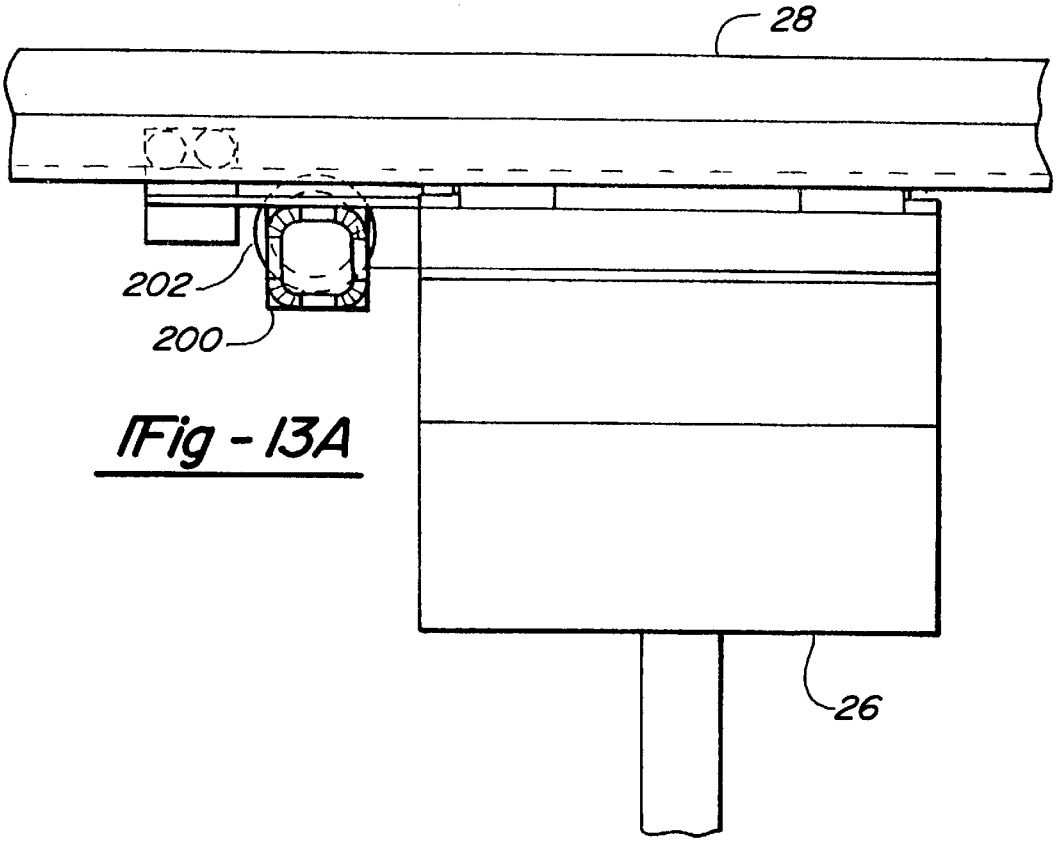
FIGS. 13A–13C are views of motors for driving the system within the frame.
Figure 13B:
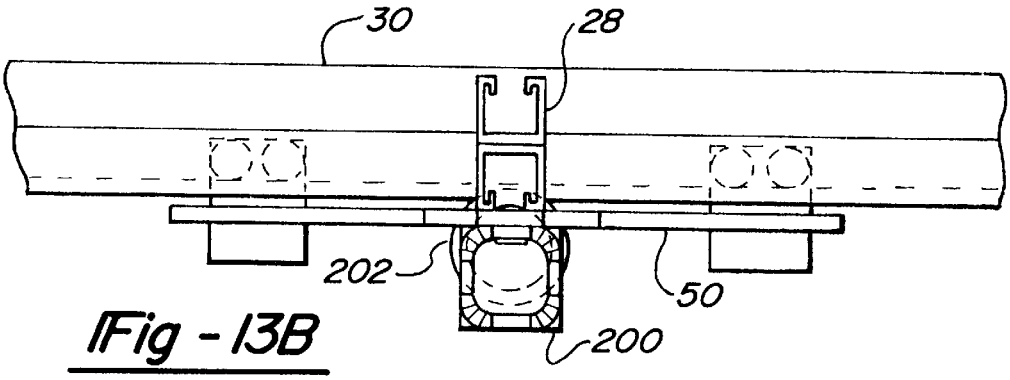
Figure 13C:
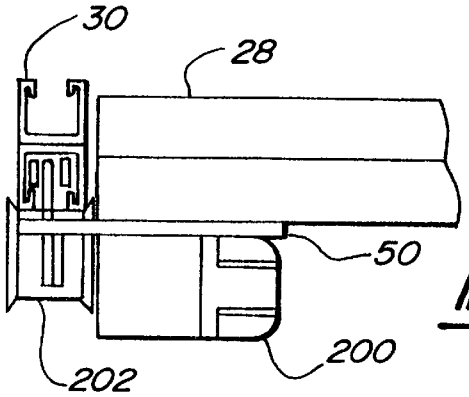

As an alternative embodiment, a motor drive for moving the hoist assembly along transverse bar 28 and for moving transverse bar 28 along the laterally extending bars 30 is incorporated into this invention. This is illustrated in FIGS. 13A, 13B, and 13C, respectively. As shown in FIG. 13A, a rotary motor 200 may drive friction wheel 202 along transverse bar 28 to position hoist 26 along bar 28 free length. As shown in FIGS. 13B and 13C, a similar motor or motors 200 may drive friction wheel(s) 202 along lateral bar(s) 30 to position transverse bar 28 about bar 30 free length. All motors 200 would be controlled by a system controller. Obviously, other motor and drive arrangements could be used.

FIG. 2 shows a detail of a corner bracket assembly 42, which is utilized at each corner of frame 22. As shown, lower support plate 43 is positioned below a lower face of both the laterally extending bar 30 and the longitudinally extending bar 34. Rear plates 44 are positioned outwardly of the laterally extending bar 30 and the longitudinally extending bar 34. In this way, the plate 43 and plates 44 provide a rigid support for the connection of the bars 30 and 34 to the corner bracket 42. A bolt 45 extends through bracket 42 to secure bracket 42 to the leg 32. Bolts 46 extend through lower plate 43 and into nuts 48 received within the channels of the bars 30 and 34. Although any type of channel structure may be utilized for the bars, Applicant has found that bars containing channels available under the trademark Unistrut™ or Beeline™ are acceptable for the present invention. While the structure of the channels, nuts, etc., utilized in this application may be standard when specific disclosure of a structure is given in this application, the structure is deemed part of the invention of this application. Even so, in place of inventive structure such as corner bracket 42, it may be possible to use standard Unistrut brackets and still achieve the main goals of the patient lift system of this invention.

A main beneficial aspect of this invention may be understood from FIG. 3. As shown, transverse bar 26 carries brackets 50, which are supported on laterally extending bars 30. The longitudinal ends of transverse bar 28 are received between the internally extending bars 30. Transverse bar 28 is mounted at approximately the same vertical position as the laterally extending bars 30. This provides beneficial improvements over prior art assemblies wherein the moving bar is supported vertically below the frame structure. In those prior art systems, valuable patient lift height is lost due to the mounting arrangement. As can be understood from the combination of FIGS. 1 and 3, there is a limited amount of space for lifting the patient above bed 38. The inventive arrangement of placing the transverse bar 38 at the same vertical location as the laterally extending bars 30 provides valuable additional lift height that allows an operator to lift the patient upwardly off of the bed 38. The prior art structure did not always allow such lifting, particularly in low-ceilinged rooms. Additionally, as shown, corner support braces 52 connect each of the laterally and longitudinally extending bars 30 and 34.

As shown in FIG. 4, ends of transverse bar 28 are fixed to a bracket 50 having flanges 54 bolted to plates 56. Plates 56 carry a pair of spaced wheels 58 at two laterally spaced locations. As will be shown below, each of the wheels 58 is supported on one lip of a channel 60 in the laterally extending bar 30. As is also clear from FIG. 4, the transverse bar 28 is at the same vertical height as the laterally extending bars 30. The motor is mounted to the transverse bar 28, and this arrangement thus provides valuable additional patient lift height. Bolts 62 connect bracket 50 to nut 64 within a channel in transverse bar 28.

As shown in FIG. 5, with the inventive structure, wheels 58 roll along in-turned lips 59 within channel 60 on laterally extending bar 30. Plate 56 is bolted to flange 54 on bracket 50, which is, in turn, bolted to the transverse bar 28. As can be seen, transverse bar 28 is mounted at approximately the same vertical location as laterally extending bar 30.

As shown in FIG. 6, transverse bar 28 carries the motor 26, including an enclosed box 66, with a control plate 68. Control plate 68 includes a number of battery power warning lights 65 and a rheostat speed control 67 for controlling the speed at which the motor lifts the patient, as will be described below. Arms 70 are mounted for facilitating movement of the motor along the transverse bar 28. As will be explained below, the box 66 is mounted for movement along transverse bar 28.

It is envisioned that the warning lights 65 may include three different color lights giving incremental reports on the status of the battery power. As an example, there may be green, yellow and red lights with green indicating an acceptably charged battery, yellow indicating that the battery power is becoming low, and red indicating that the battery power is become dangerously low. Patient lift systems of this type are not used constantly, but rather are called upon to lift a patient when it becomes necessary. Thus, when an operator wishes to use a patient lift system and only then learns that the battery is dead, the operator will be unable to lift the patient. This is undesirable, and the incremental warning lights will provide that operator with an indication that battery charging is required before the battery is completely exhausted, and the system may no longer be used, but must be recharged. The warning lights 65 are preferably provided with circuitry that allows the boundaries between the three colors to be adjustable. The boundaries will be set such that the red light is actuated when substantial battery life still exists. The rheostat 67 allows control of the motor speed such that one may slow the lifting when an elderly or particularly delicate or thin patient is being lifted.

It is preferable that the motor control be provided with circuitry such that the battery within the motor box 66, as will be described below, may be charged with a standard battery charger that may be plugged into a wall outlet. Such battery chargers are known, and can recognize different currents that are typically used across the world, and change the current and voltage into that necessary for charging the 12-volt battery that is preferably utilized with the inventive system.

As shown, bars 70 facilitate movement of the motor along transverse bar 28. An "instant on/instant off" switch 71 is shown on bar 70. Switch 71 can be moved into either of two positions to control lifting or lowering of the belt 72, and hence a patient. Switch 71 is preferably of the type that returns to a neutral or "off" position in the event that an operator is not biasing the switch 71 towards the raise or lower position. In this way, problems associated with a constant on or off switch involving undue movement either upwardly or downwardly of the belt 72 are eliminated.

A belt 72 extends from motor box 66 and can be lifted or lowered relative to motor box 66. A ring 74 secures a patient lift bar 76 having two forward lift points 78 and two rearward lift points 80. As will be explained below, the lift points facilitate the ease and comfort with which the patient will be supported on the inventive patient lift system of this invention.

As shown in FIG. 7, an electromagnetic brake 82 is associated with the motor 83, which is in turn connected through a speed reducer 84 to a spool 85 for the belt 72.

Electromagnetic brake 82 is connected to control circuitry for the motor 83 and is actuated to hold the motor 83 against movement when the motor control determines that the belt should not be lifted or lowered. The use of the brake 82 holding the motor stationary holds the belt 72 against movement, such that a patient supported in the lift assembly, would not be subject to bouncing or movement when the motor 83 is deactivated.

In addition, a section 86 of nonreflective material may be attached to belt 72. Section 86 will provide an "end of travel" signal to the motor control indicating that the belt has lifted to the total extent, and thus that the motor 83 should be stopped.

L-brackets 89 are preferably bolted to a top plate 95 of the motor box 66. Plates 91, similar to the plates 56 described as being associated with brackets 50, are bolted through bolts 90 between the brackets 89. At each end of the brackets 89, guide bearings 93 are mounted, which are received within a channel in transverse bar 28. Wheels 92, are mounted on both sides of plate 91, similar to the plate 56 associated with bracket 50. Guide rollers 93 insure that the motor is properly guided within transverse bar 28, and wheels 92 insure that the motor rolls smoothly and freely along the bar 28.

A strain gauge 120 is shown schematically and may be utilized to weigh a patient supported on the lift assembly. Strain gauge 120 may be connected to an output such that the patient's weight would be displayed.

Figure 8:
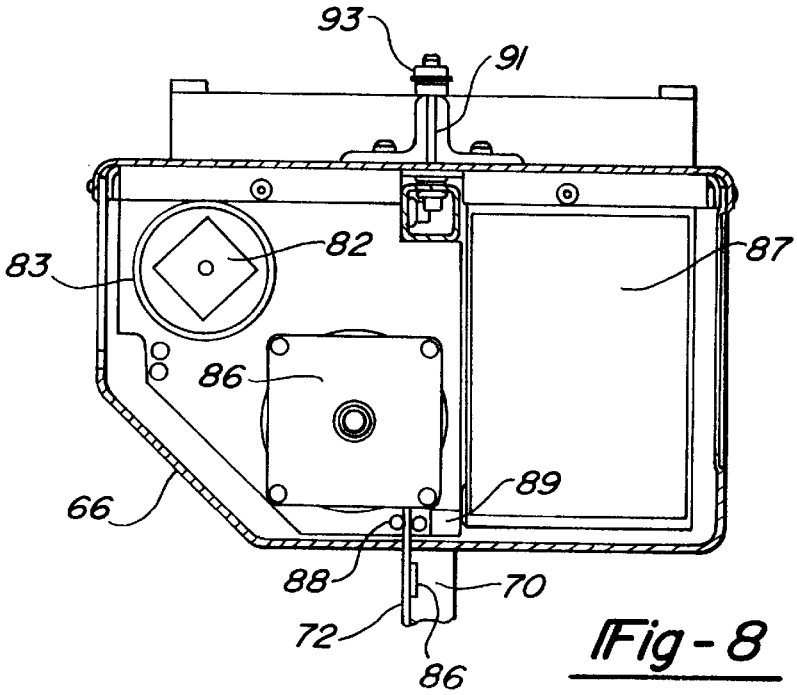
FIG. 8 is a cross-sectional view taken at approximately a 90-degree angle relative to the view shown in FIG. 7.

As shown in FIG. 8, 12-volt battery 87 is mounted near a rear portion of the motor box 66. As also shown, belt 72 extends between pins 88, with section 86 shown approaching entry into box 66. A sensor 89, which may be an LED with the capability of sensing a bounce-back reflection, is shown schematically positioned adjacent to pins 88. During lifting of a patient by motor 83, the LED 89 is preferably sending a light off belt 72. When that light hits section 86, light will not bounce back at the sensor 89, which will sense that the belt is approaching an end of travel position, and will thus deactivate the motor 83.

As has been previously described, a rheostat control allows adjustment of the speed of motor. In addition, it is preferred that the motor controls have a "slow stop-slow start" capability. That is, pulses will be initially sent to the motor control which are spaced, to allow easy and smooth slow start-up of the motor for both lifting and lowering a patient. In addition, it is preferred that the brake 82 be activated prior to the motor being stopped, to slow the stopping of movement of the patient, and eliminate a jarring stop. It is preferred that the control structure for this invention be 100 percent solid state. The solid state control has no moving parts, such as limit switches, and is thus more reliable and long lasting. Due to the solid state control, only a small control current need go to the switches, reducing shock hazard. Also, the solid state control is much lighter than prior art controls. The control is preferably adapted to recognize and utilize world-wide electric systems. A microprocessor based controller is most preferred. With the solid state control, many options and benefits may be easily incorporated. Strain gauge 120 might not be useable without such a control. Also, the control allows variations as described below. The solid state control may be potted to increase its life. The details of such circuitry would be apparent to those skilled in the art.

As shown, control panel 65, see FIG. 6, includes a jack 122 that may receive a hard control device which may be hand held by the operator at a distance from the motor. Such a control is shown schematically at 123 in FIG. 6. It is envisioned that the control circuitry for the motor control include two parallel actuation circuits, one from switch 71, and the other from jack 122, such that the lifting and lowering of the patient can be controlled from either control.

As additional embodiments envisioned within the scope of this invention, the control includes a jack 127 that receives a plug in circuit chip such that a "joystick" 125 may control both lifting and movement of the lift structure. Alternative controls 125 may be plugged into jack 127, such as an infrared or RF controller that may initiate lifting and movement of the patient lift system. Such technology is commonly used in television remote controls, and a worker of ordinary skill in the art would recognize how to incorporate such controls into this invention. As another alternative, the lifting and movement of the patient may be controlled by plugging a voice recognition chip 125 into the motor control. Such voice activated technology is also well-known in the relevant arts, and could be incorporated into the invention as disclosed. Each of the above control options could be "plugged" into the main control board inside the housing.

Figure 9:
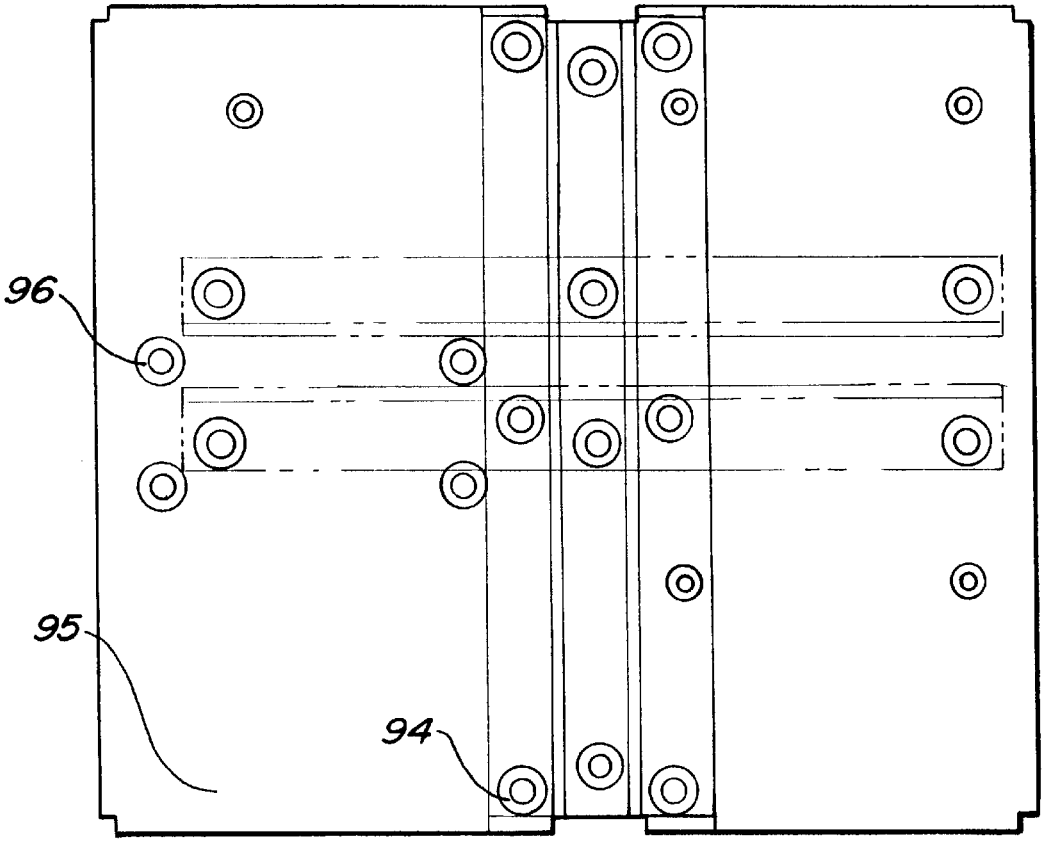
FIG. 9 is a view of the top plate for the motor structure of the present invention.

FIG. 9 is a view of top plate 95 utilized to connect the motor box 66 to the transverse bar 28. As shown, the L brackets may be connected extending in either of two directions on plate 95 spaced from each other by 90 degrees. The L-brackets can be connected at the bolt holes shown generally by 94 or may be alternatively connected to holes 96. In this way, an operator can control the orientation of the motor relative to the transverse bar 28.

Figure 10:
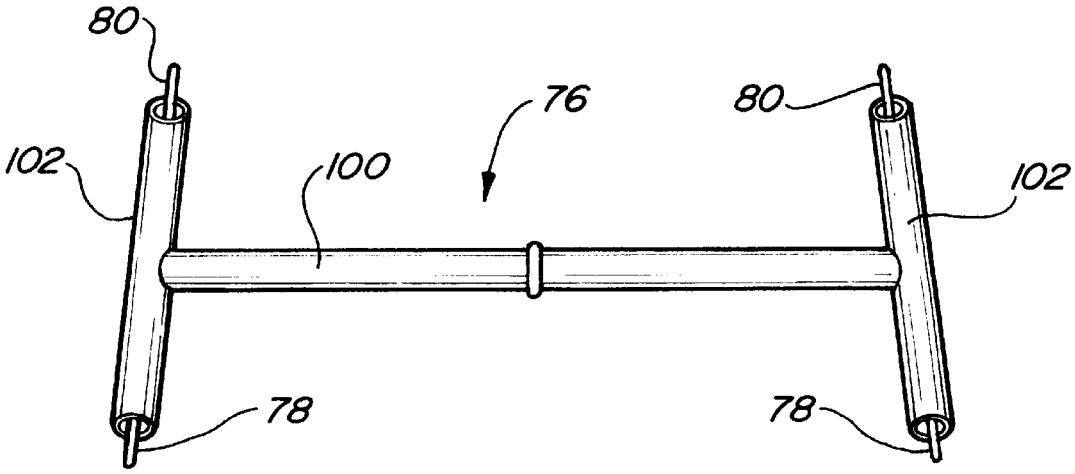
FIG. 10 is a top view of a patient lift bar according to the present invention.

The patient lift bar 76 is shown in FIG. 10, having the front lift points 78 and rear lift points 80. By reviewing FIG. 10 and FIG. 6, it can be seen that a front bar portion 100 curves between two side bar portions 102. As shown, side bar portions 102 extend at an angle relative to front bar portion 100, such that the rear lift points 80 are closer together than the front lift points 78. This provides greater support at the patient's back, where it is most necessary. At the same time, the relatively greater distance provided at the front lift points 78 increases the patient's comfort, and also facilitates movement of the patient into and off the lift assembly.

Figure 11:
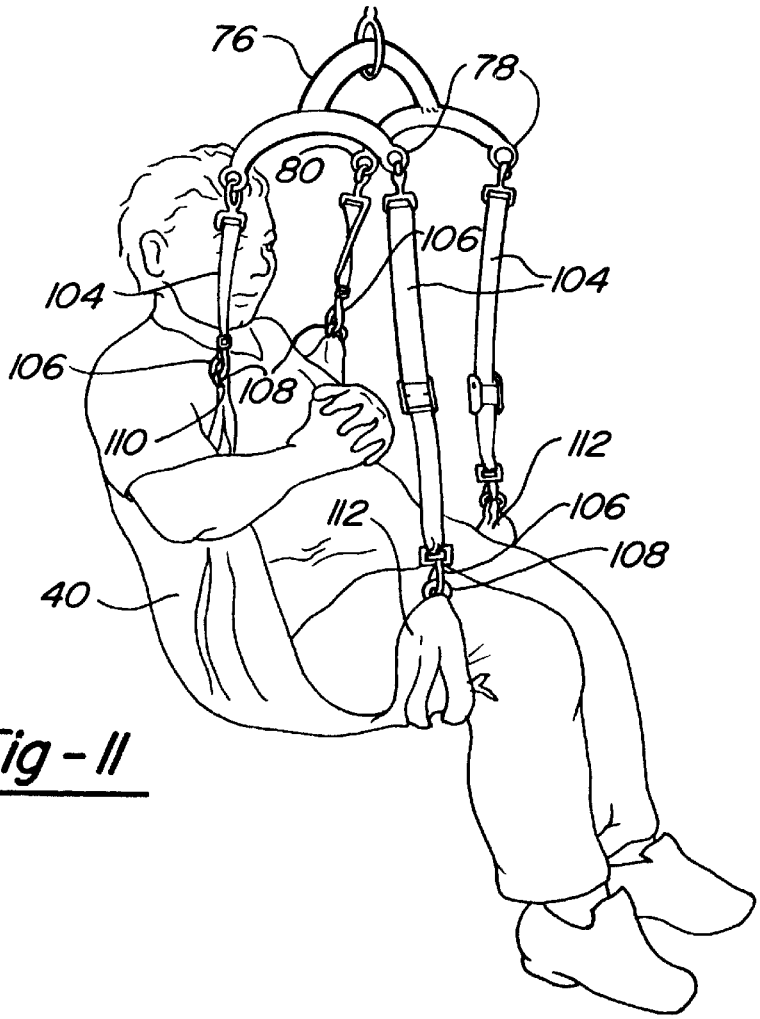
FIG. 11 is a perspective view of a patient supported on the patient lift sling of the present invention.

As shown in FIG. 11, a patient 103 is mounted on lift bar 76. Lift belt portions 104 extend from the lift points 78 and 80 to buckles 106, which are received in rings 108 in sling assembly 40. As shown, lift portions 110 of the sling 40 support the rear of the patient, while lift portions 112 of the sling support the front of the patient.

The sling is preferably lowered onto the patient's bed and slid underneath the patient. The four point connections are then made and the patient can be lifted off the bed.

Figure 12:
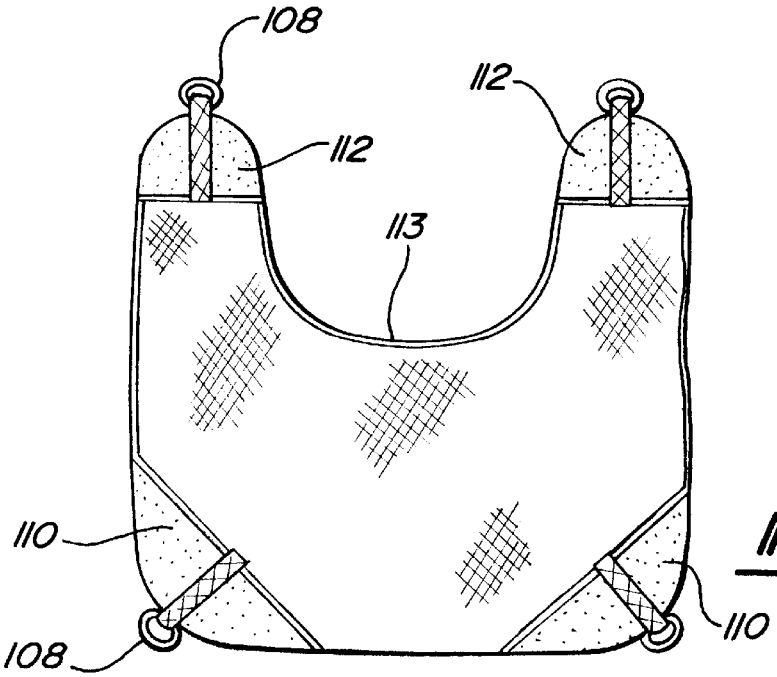
FIG. 12 is a plan view of the sling incorporated into the patient lift system of the present invention.

As shown in FIG. 12, the front support portions 112 are created by extensions that could be termed "legs. " By comparing FIGS. 11 and 12, it should be apparent that the legs 112 are crossed to support the patient. In this way, the generally U-shaped opening 113 between the legs 112 as shown in FIG. 12, leaves an opening which facilitates the use of a toilet by the patient.

In another feature of this invention, the sling 40 is formed of a polyester mesh material which may be washed. Since the rings 108 are received on the sling and buckle portions 106 are not, the sling 40 may be easily washed. In the past, buckles have been mounted on patient lift members and have made the use of standard washing machines impractical for cleaning the slings. It is envisioned that the sling assembly of this invention may be sold with a mesh bag that may carry information about the patient such that the entire assembly may be simply tossed into a washing machine for cleaning.

Figure 14:
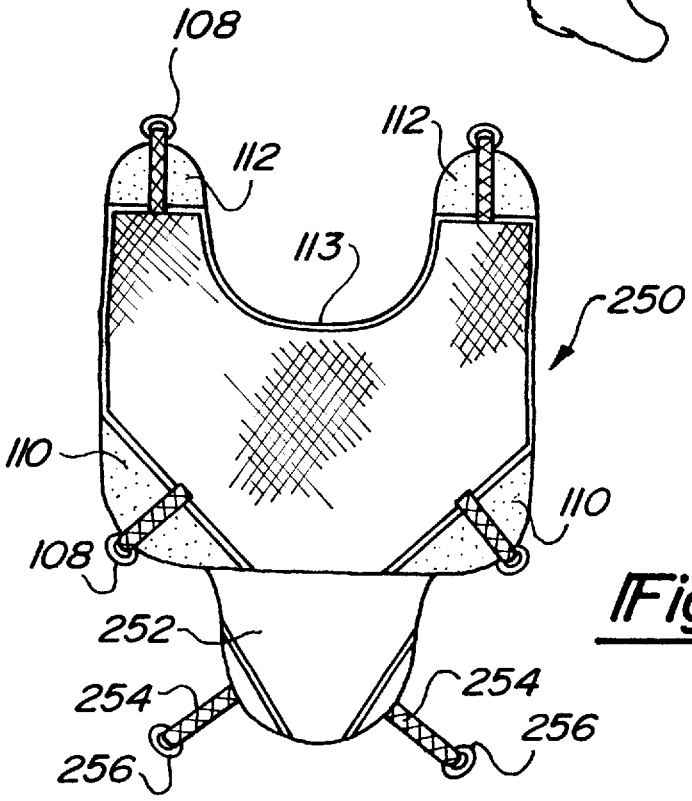
FIG. 14 shows a second embodiment sling.

As shown in FIG. 14, a second embodiment sling 250 is similar to the first sling, however, a head support portion 252 extends from the rear portion of the sling. Straps 254 extend to hooks 256 to support the head portion 252.

Figure 15:
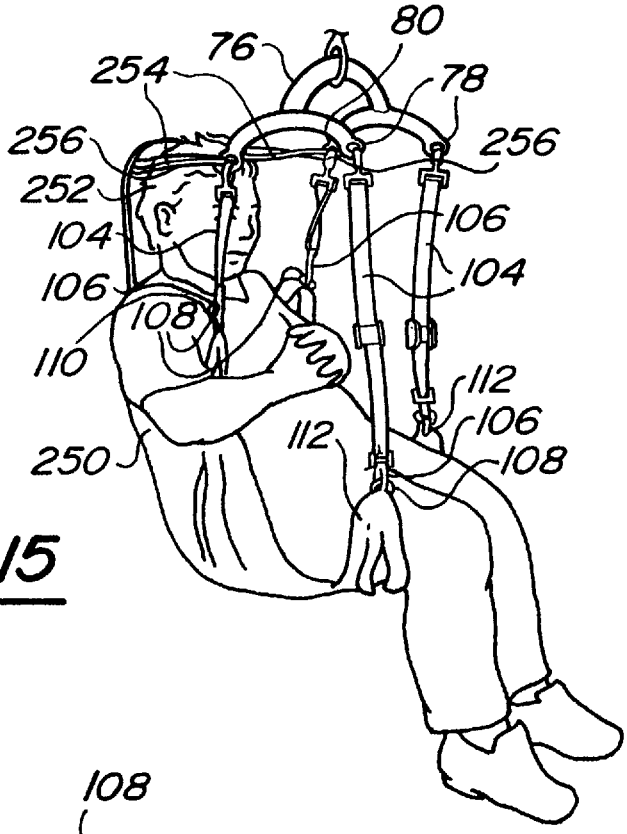
FIG. 15 shows the second embodiment sling supporting a patient.

As shown in FIG. 15, with the head portion 252 supporting a patient's head, the straps 254 are connected through the hooks 256 to the rearmost of the four support points on the support bar 76. Thus, the inventive sling also supports the patient's head, such that the patient is more comfortable.

Figure 16:
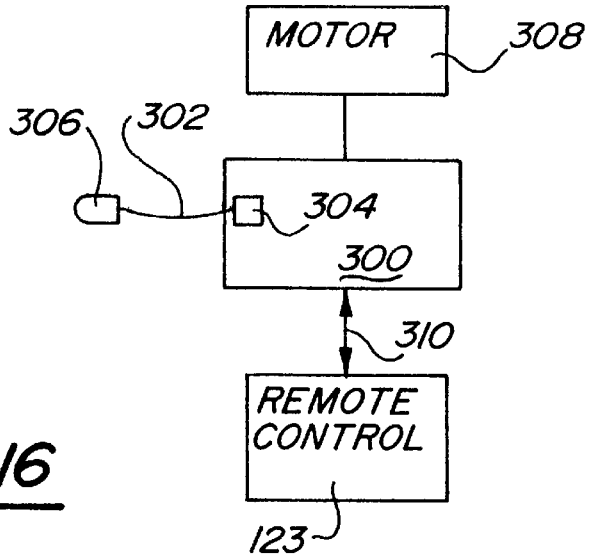
FIG. 16 is a schematic view of a control feature of this invention.

FIG. 16 is a schematic representation of control features for this invention. A circuit board 300 receives a control line 302 which is plugged into the board at 304 to connect the sensor 306. The sensor may be of the type previously disclosed which monitors the position of the belt.

In addition, power to the motor 308 is controlled through this control circuit board. A control line 310 leading to the remote control 123 receives a lower voltage and lower current than that going to the motor. Only a small control voltage is necessary, and by limiting the voltage and current in line 310, the user of the remote control 123 is safer.

Figure 17:
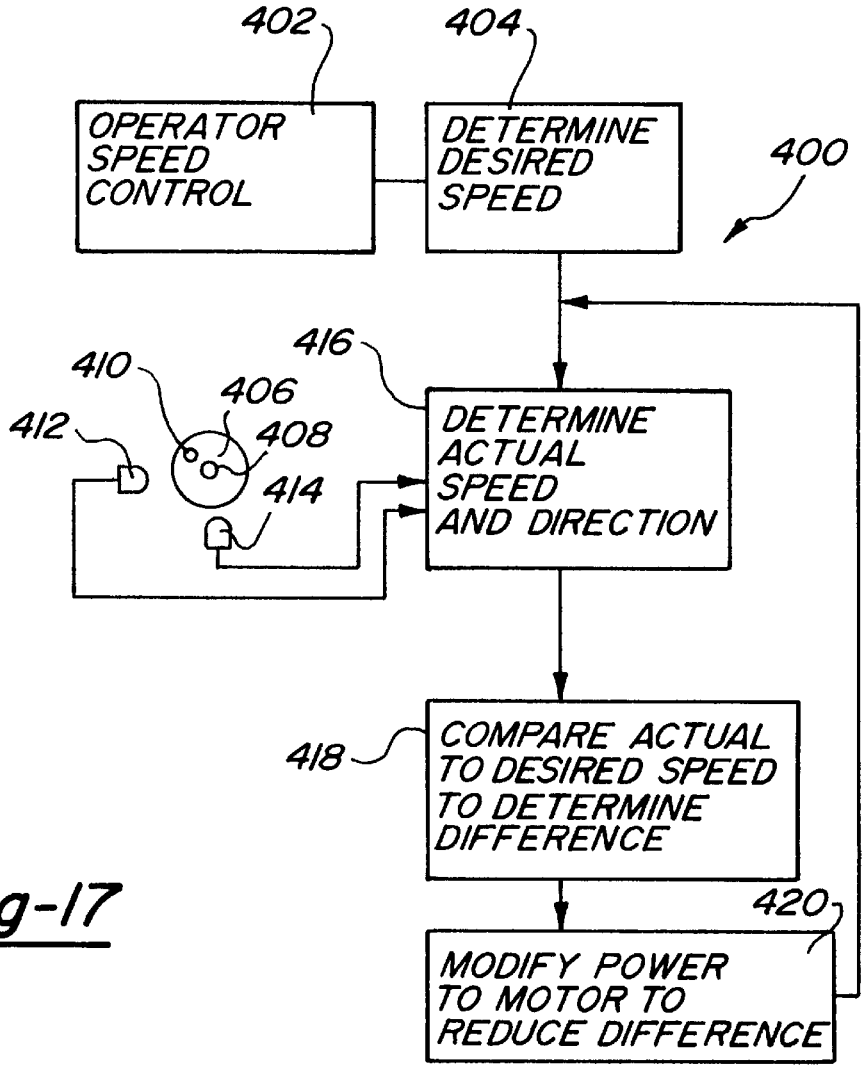
FIG. 17 is a flow chart showing other control features.

FIG. 17 is a flow chart which also shows schematic features of the invention which assist in speed control. As shown in the flow chart 400, the operator speed control input 402 may be a rheostat control knob placed in an easily accessible area. By turning the knob, the desired speed determined at box 404 may be adjusted. Actual speed is determined by a rotary disk 406 attached on the shaft 408 of the motor. A location such as location 410 on the rotary disk 406 may be sensed by two sensors 412 and 414 which are spaced by some angular distance. In this embodiment they are shown spaced by 90 degrees. Now, when sensors 412 and 414 sense passage of the spot 410, the sensors send the signals to a control. The control preferably includes a microprocessor. In box 416 the control determines the actual speed and direction of the motor based on the signals from sensors 412 and 414. The structure of the sensors may be of any known optical sensor type.

In box 418, the controller compares the actual to the desired speed to determine whether there is a difference. If there is a difference, then the controller modifies the power to the motor to reduce that difference. Thus, there is a feedback loop back to the controller based on the actual speed which has been determined. With this invention, the present motor control is able to slow the descent of the system when a particularly heavy patient is being moved. In the prior art systems which had no feedback, it is possible that a particularly heavy patient could reach undesirably high speeds on the descent. With the present invention and its feedback loop, such speeds will not occur. Moreover, when a particularly heavy patient is being lowered it is sometimes necessary to actually reverse the direction of the motor to slow the speed and achieve the desired speed. The present invention is capable of performing such a reversal.

One other method aspect of this invention utilizes the patient lift system to begin rehabilitation of a patient who has lost the ability to walk. By supporting the bulk of the patient's weight on the lift system, the patient is able to begin walking again, without having to support the weight. Thus, the patient's weight can be slowly transferred back to the patient as the patient becomes more adept at walking.

A preferred embodiment of this invention has been disclosed; however, a worker of ordinary skill in the art would recognize that certain modifications would come within the scope of this invention. For that reason, the following claims should be studied in order to determine the true scope and content of this invention.

We claim:

1. A patient lift system comprising:

a frame for supporting a patient lift motor;

a motor for lifting and lowering a patient;

said motor being connected to a patient lift bar incorporating four lift points, a sling being connected to said four lift points to raise and lower a patient, said sling having a head support portion, said head support portion being associated with two head portion connection members, and said two connection members being each connected to one of said four lift points; and said sling includes two additional straps and connection members associated with a rear portion of the sling spaced from said head portion, and two other connection members associated with front portions of said sling, said connection members associated with said front portion of said sling being connected to two forward lift points on said lift bar, and said head portion connection members and said rear connection members all being connected to two rear lift points on said lift bar.

2. A patient lift system as recited in claim 1, wherein said four lift points include two forward lift points and two rearward lift points, said two rearward lift points being spaced from each other by a distance which is less than a distance by which two forward lift points are spaced.

3. A patient lift assembly as recited in claim 1, wherein said sling is connected to said patient lift bar by hooks selectively connected to rings.

4. A patient lift assembly as recited in claim 1, wherein said hooks are received on said patient lift bar, with said rings being positioned on said sling, to facilitate cleaning of said sling.

5. A patient lift system comprising:

a frame for supporting a patient lift structure;

a motor supported for movement along said frame, said motor being connected to a patient lift structure for supporting, lowering, and raising a patient;

a solid state motor control allowing selective control of said motor for raising and lowering said patient; and an instant on/off switch is included for actuating said motor, said switch being of the type which turns said motor off when not held in a position to actuate the raising or lowering functions;

wherein speed sensors determine the actual speed of the motor, and compare the actual speed to a desired speed, the power from said motor control delivered to said motor being varied if there is a difference between said actual and desired motor speeds, and wherein said speed sensors are optical sensors associated with a motor shaft.

6. A patient lift system as recited in claim 5, wherein said motor speed control includes a rheostat adjustment allowing control of the speed of said motor.

7. A patient lift system as recited in claim 5, wherein a belt is connected to a patient lift bar, said belt being raised and lowered by said motor.

8. A patient lift system as recited in claim 7, wherein a sensor is mounted on said motor at a position such that it is adjacent to said belt, and said belt includes a signaling portion such that as said signaling portion moves adjacent to said sensor, said sensor can sense that said belt is near an end of travel position, and said sensor sending a signal to said motor control.

9. A patient lift system as recited in claim 8, wherein said sensor is connected to a control circuit board by a plug in connection.

10. A patient lift system as recited in claim 5, wherein a hard-wired remote control is connected into the system such that an operator may hold said remote control and remotely actuate the raise and lowering functions of the motor.

11. A patient lift system as recited in claim 5, wherein a motor lift control is voice activated.

12. A patient lift system as recited in claim 5, wherein a motor lift control is actuated by an electromagnetic signal from a hand-held controller.

13. A patient lift system as recited in claim 5, wherein the system includes motors for driving the patient lift system in two directions, the movement of the patient lift system being controllable from a remote location.

14. A patient lift system as recited in claim 5, wherein the motor is driven by a 12-volt battery and there are provided battery level indicator lights.

15. A patient lift system as recited in claim 5, wherein said battery is provided with a recharging circuit, said recharging circuit being constructed to identify and utilize various types of electric power supply.

16. A patient lift system as recited in claim 5, wherein said motor control is microprocessor based.

17. A patient lift system comprising:

a frame for supporting a patient lift structure;

a motor supported for movement along said frame, said motor being connected to a patient lift structure for supporting, lowering, and raising a patient;

a solid state motor control allowing selective control of said motor for raising and lowering said patient;

an instant on/off switch is included for actuating said motor; said switch being of the type which turns said motor off when not held in a position to actuate the raising or lowering functions;

wherein a hard-wired remote control is connected into the system such that an operator may hold said remote control and remotely actuate the raising and lowering function of the motor; and said motor control sends a first relatively high voltage and current to said motor, and a second relatively low voltage and current being sent to said hard-wired remote control.

18. A patient lift system comprising:

a frame for supporting a patient lift structure;

a motor supported for movement along said frame, said motor being connected to a patient lift structure for supporting, lowering, and raising a patient;

a solid state motor control allowing selective control of said motor for raising and lowering said patient; and wherein speed sensors determine the actual speed of said motor, and compare the actual speed to a desired speed, the power from said motor control delivered to said motor being varied if there is a difference between said actual and desired motor speeds, said comparison of actual to desired speed insuring the weight of a patient will not cause the lift structure to lower the patient too quickly and in excess of a desired speed.

19. A patient lift system as recited in claim 18, wherein said speed sensors are optical sensors associated with a motor shaft.

20. A patient lift system as recited in claim 19, wherein said desired speed is provided by an operator input switch.

* * * * *